United States Patent [19]

Mong-Sheng

[11] Patent Number: 4,861,303

[45] Date of Patent: Aug. 29, 1989

[54] TOY BUBBLE PIPE WITH BLOW AIR-ACTUATED PIVOTING ANIMAL SHAPED BLOWPIPE

[76] Inventor: Lin Mong-Sheng, P.O. Box 96-405,, Taipei 10098, Taiwan

[21] Appl. No.: 89,985

[22] Filed: Aug. 28, 1987

[51] Int. Cl.[4] ..... A63H 33/28; A63H 3/28

[52] U.S. Cl. ..... 446/17; 446/20; 446/185

[58] Field of Search ..... 446/15–20, 446/21, 183, 185, 199, 325, 360

[56] References Cited

U.S. PATENT DOCUMENTS

| | | | |
|---|---|---|---|
| 1,504,186 | 8/1924 | Evans et al. | 446/20 |
| 2,587,535 | 2/1952 | Scott | 446/18 |
| 2,625,768 | 1/1953 | Magnus | 446/17 |
| 2,854,788 | 10/1958 | Baggott | 446/183 |
| 3,093,925 | 6/1963 | Greene | 446/18 |
| 3,736,694 | 6/1973 | Lebensfeld | 446/16 |

FOREIGN PATENT DOCUMENTS

| | | | |
|---|---|---|---|
| 474784 | 12/1953 | Italy | 446/20 |

*Primary Examiner*—Robert A. Hafer
*Assistant Examiner*—D. Neal Muir
*Attorney, Agent, or Firm*—Lowe, Price, LeBlanc, Becker & Shur

[57] ABSTRACT

A kind of toy for blowing bubbles has its head portion made into being able to sway in the shape of an animal. The main body and air blowing structure are connected. The air blowing structure is provided with a piston and piston shaft to the swaying portion to takeup the bubble liquid when it hangs down. The swaying portion is driven by the piston and piston shaft to turn upward and to produce large quantity of bubbles swiveling in air to amuse the player and spectators.

1 Claim, 2 Drawing Sheets

TOY BUBBLE PIPE WITH BLOW AIR-ACTUATED PIVOTING ANIMAL SHAPED BLOWPIPE

BACKGROUND OF THE INVENTION

1. Field of the Invention

The present inv ention is related to a kind of toy for blowing bubbles. Particulary the toy achieves the purpose of blowing bubbles by means of the formation of the bubbles in oscillating froth solution to be driven by the blowing air.

2. Description of the Prior Art

A kind of the prior art is that the toy for blowing bubbles is made up of spring ring entwined with winding fine iron wire to be installed at the front end of a blowing pipe. It uses the spring ring dipped in froth solution and then the user holds the blowing pipe in the mouth and blows the air upon the spring ring which has taken up the froth solution. The solution is then driven by the air blown by the player to form a large quantity of bubbles to fly away in all directions.

In such prior art, the spring ring must be adhered by bubble solution and then the blowing of the bubbles can be done. Each time when the bubble solution stays on the spring ring and then the bubbles are blown out, the player must wait for a moment and he can not blow bubbles out consecutively.

Another prior art is that the toy has an air supply pump installed within the toy for the supply of air, and also it provides its movement mechanism and the moving of the toy's arm for blowing bubbles. By means of a spring ring installed on the toy's arm, it can move into the chamber in which the bubble solution is contained when the arm moves. At that time, the arm touches the solution liquid. Then the spring ring moves further through the exit mouth of the air supply pump. As it is driven by the air, a large quantity of bubbles are forming and flying in air.

In the prior art, the main body of the toy directly produces the driving force and blowing air to the bubbles. Such toy's main body fails to provide the pleasure to the child who blows bubbles.

SUMMARY OF THE INVENTION

The present invention's toy for blowing bubbles aims to embody in the form of an animal. Its head portion is equipped with a swaying component, and its mouth is installed with the blowpipe for the bubbles. Its body structure is connected with the air blowing parts. In the air blowing parts, there are a piston and piston shaft to be able to drive the upper part of the swaying component and to supply air to the swaying portion. The mouth of the toy for blowing bubbles is installed with the blowpipe to form bubbles. The inside of the blow pipe is equipped with the spring ring. When the spring ring is fully covered with bubble liquid and the air is supplied, a large quantity of bubbles fly away in air.

The purpose of the toy for blowing bubbles in the present invention is that its body is made in the form of an animal, which is connected with the air blowing structure. The latter consists of the blowpipe and air blowing mouthpiece. The inside of the blow pipe contains the piston and piston shaft. Its end and swaying portion are connected with the drive plate to make the swaying portion to drive upward when the moutpiece is blown.

The toy for blowing bubbles in the present invention has another purpose in that the air blowing structure and main body of the toy are connected and communicable. So the air can enter the body through the air blowing mouthpiece. Besides, the main body has connection holes. After the piston shaft is compelled to drive the swaying portion upward, the air enters the swaying portion to produce a large quantity of bubbles which fly away in the air through the blowpipe and spring ring because the swaying portion has its parts near to the holes of the main body where there are similar holes just as those of the main body.

The other purpose of the toy in the present invention is that at the front end of the blowing structure, there is a bubble solution liquid dispenser in which there is a bubble solution liquid supply chamber so that the swaying portion may touch the bubble liquid directly when it lowers. The bubble solution liquid chamber is equipped with a guide pipe extending to the outer part of the lower end to be connected with a liquid uptake chamber to supply the bubble liquid.

The toy for blowing bubbles has another purpose in that the liquid tank chamber is equipped with an expansion pipe. When the liquid tank chamber refills the new liquid, one just presses the bubble liquid tank chamber to enable the bubble liquid to pass through the guide pipe into the chamber.

DESCRIPTION OF THE PREFERRED EMBODIMENT

Figure 1:
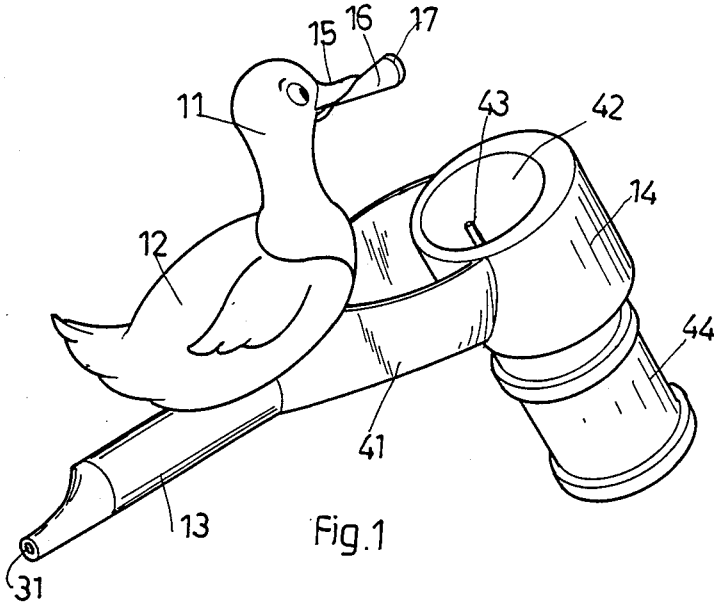
FIG. 1 is a perspective view of the present invention.
Figure 3:
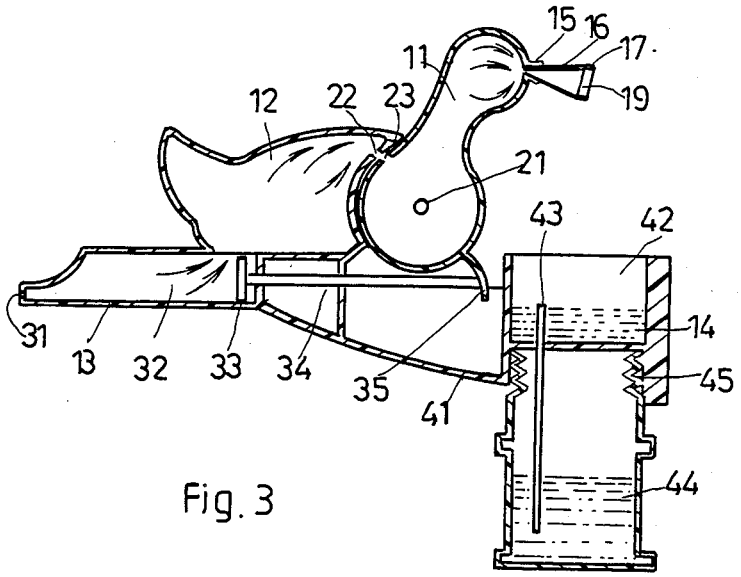
FIG. 3 is a cross section view showing operation when the bubbles are being blown in of the present invention.
Figure 4:
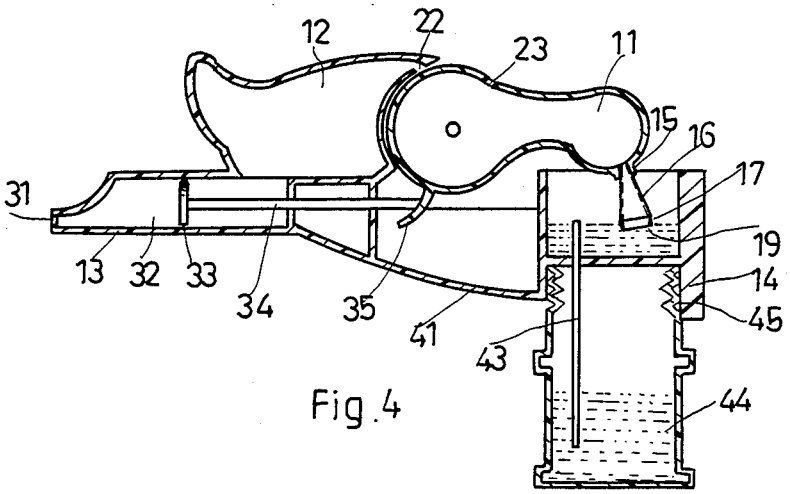
FIG. 4 is a cross section view showing when the spring ring is covered with the bubble soluation liquid.

In respect of the application of the present invention, please refer to FIGS. 1, 3 and 4. The toy for blowing bubbles is a device in the form of a animal. The structure consists of the swaying portion 11, main body 12, air blowing structure 13 and the system for the supply of the bubble solution liquid 14. The device of the swaying portion 11 is in the shape of an animal's head. At its mouth 15, there is a bubble blow pipe 16. The blow pipe is in the shape of a trumpet. At the inner edge of its mouth 17, there is a spring ring 19 which has been wound by fine iron wire.

Between the swaying portion 11 and body 12, there is a turning shaft 21 for axis connection. After the turning shaft is connected in axis, the eccentric weight of the swaying portion may direct sway downward.

The body 12 of the toy for blowing bubbles is made so that its inner portion is hollow. Its outer appearance is like the shape of an animal. The bottom of the body and the air blowing structure are connected and communicable. There are connection holes 22, 23 respectively on the contact surfaces of the edges in turning between the main body 12 and sway portion 11. The installation of the connection holes is to enable the holes 22, 23 to send the air to the swaying portion 11 and bubble blow pipe at its mouth 16 when the air blowing portion 13 sends the air through the spring ring 19 covered with the bubble solution liquid to produce a large quantity of bubbles flying in the air.

In the structure of the air blowing structure in the present invention, the structure 13 consists of air blowing mouthpiece 31 and air blowing pipe 32 which are connected with the main body 12 to enable the air to enter the swaying portion 11 from main body 12 after the air is blown into the body. Within the air blow pipe 32, there are piston 33 and piston shaft 34. There are drive plates in adjacent positions which are respectively installed at the end of piston shaft 34 and swaying portion 11 so that the swaying portion 11 can sufficiently move up and down. Except that the main body's eccentric weight can automatically hang downward, its upward swing force depends upon the air blown through the air pipe 32 and the swaying portion 11 is driven by the piston 33 through the piston shaft 34 to move upward.

In the process of blowing bubbles, the spring ring 19 touches and is covered with the bubble solution liquid when the swaying portion 11 hangs downward by means of the front end of the air blowing portion to be equipped with the supply system of bubble solution liquid. When the air is blown into the air blowing portion 13, the piston 33 and piston shaft 34 in the air blowing pipe 20 operate to make the swaying portion 11 to turn upward through the pushing of the drive plate 35 of the swaying portion 11. The connection holes 23 are opposite against the connection holes 22 of the main body. The air may enter the swaying portion from the main body 12 and then the spring ring 19 at the mouth of the blow pipe 16 is effected by the air flow function to produce a large quantity of bubbles flying in air.

The supply portion 14 of the bubble solution liquid in the toy has the connection plate 41 to be connected with the air blowing portion so that the swaying portion can touch and be covered with the liquid when it hangs downward. At the supply system for the bubble solution liquid 14, there is a liquid supply chamber 42 to contain the bubble liquid. There is installed a guide pipe 43 in the proper position of the side end of the supply chamber 42. The guide pipe extends downward from the liquid supply chamber. At the extension portion downward of the guide pipe, there is installed a liquid tank chamber 44. The liquid tank chamber 44 has expansion pipe 45 and liquid supply chamber 43 in connection with the lower end body for provision of the storage of bubble liquid and the handle for the player to hold when he blows the bubbles.

Figure 2:
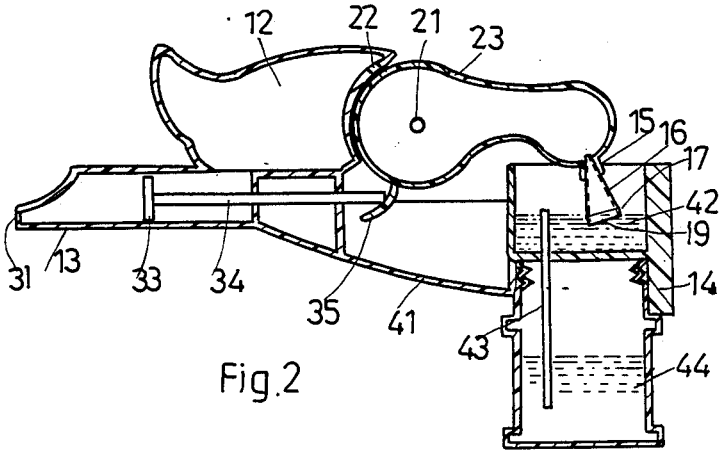
FIG. 2 is a cross section illustration of the supply of the bubble solution liquid in the present invention.

When the bubble liquid in the liquid supply chamber 42 can not provide the liquid to the spring ring at the front end of the swaying portion as indicated in FIG. 2, the liquid tank chamber 44 may enable its existing bubble liquid by means of the upward pressing force thereon to enter the liquid supply chamber 42 through the guide pipe 43 to meet the need for blowing bubbles. Generally speaking, the toy for blowing bubbles is activated by the piston and piston shaft to drive the swaying portion upward. The air enters the connection holes and then the swaying portion to make the spring ring of the blow pipe to be covered with the bubble liquid. Then it is affected by the air flow to produce a large quantity of bubbles dissipating in the ambient atmosphere. After the spring ring is covered with the bubble liquid, the player stops the blowing of the air, and the swaying portion hangs downward as it is affected by the eccentric weight to make the spring ring to be covered with the bubble liquid again. Thus it constitutes the successive actions to blow bubbles.

I claim:

1. A toy bubble pipe comprising:

a main body portion having a hollow inner body and an outer appearance in the shape of an animal's body;

a bubble solution liquid supply chamber connected to a front part of the main body portion and extending forward of the main body portion a collapsible liquid tank chamber extending downwardly from a lower end of the liquid supply chamber, with a guide pipe extending downwardly from the liquid supply chamber into the liquid tank chamber, whereby when the liquid tank chamber is collapsed liquid may be supplied from the liquid tank chamber upwardly via the guide pipe to the liquid supply chamber;

an air blowing structure connected with a bottom portion of the main body portion and having an air blowing mouthpiece and air blowing pipe, the air blowing structure being in communication with the hollow inner body of the main body portion;

a hollow movable swaying portion pivotably mounted to the main body portion and having an outer appearance in the shape of an animal's head, the swaying portion being provided with a trumpet-shaped bubble blowpipe at a portion thereof corresponding to the animal's mouth and extending forward of the mouth, the swaying portion being eccentrically weighted to be urged to a downward position wherein the bubble blowpipe portion thereof is inserted into the liquid supply chamber, the swaying portion being provided with a drive plate;

a piston provided within the air blowing pipe of the air blowing structure and having a piston shaft engaging the drive plate of the swaying portion, the piston being drivable by blown air thereagainst in the air blowing pipe for causing the piston shaft thereof to drive the swaying portion drive plate for pivoting the swaying portion to an upward bubble blowing position whereby the bubble blowpipe portion of the swaying portion is raised from the liquid supply chamber; and connection holes respectively provided in the main body portion and swaying portion and communicable with each other when the swaying portion is in its upward bubble blowing position for supplying blown air from the inner body of the main body portion to the blowpipe of the swaying portion for blowing bubbles.

* * * * *